United States Patent [19]

Andrews et al.

[11] 4,277,290

[45] Jul. 7, 1981

[54] LOW TEMPERATURE WASHING AND CHEMICAL SANITIZING OF FOODWARE

[75] Inventors: James P. Andrews, Kernersville; Arthur C. Callahan; Moheb M. Gendy, both of Winston-Salem, all of N.C.

[73] Assignee: American Sterilizer Company, Erie, Pa.

[21] Appl. No.: 115,183

[22] Filed: Jan. 25, 1980

[51] Int. Cl.[3] ..... B08B 3/02

[52] U.S. Cl. ..... 134/10; 134/25.2; 134/26; 134/36; 134/56 D; 134/95; 134/100; 134/108

[58] Field of Search ..... 134/10, 25.2, 26, 36, 134/56 D, 95, 100, 108, 186, 57 D, 58 D

[56] References Cited

U.S. PATENT DOCUMENTS

| | | | |
|---|---|---|---|
| 2,129,944 | 9/1938 | Ladewig . | |
| 2,592,884 | 4/1952 | Fox et al. . | |
| 2,704,082 | 3/1955 | Jackson | 134/95 |
| 2,740,415 | 4/1956 | Federighi et al. | 134/58 D |
| 3,205,910 | 9/1965 | Hatch | 137/568 |
| 3,478,757 | 11/1969 | Tuthill . | |
| 4,147,558 | 4/1979 | Fraula et al. | 134/10 |
| 4,209,343 | 6/1980 | Lane et al. | 134/36 X |

FOREIGN PATENT DOCUMENTS

| | | |
|---|---|---|
| 223053 | 3/1959 | Australia . |
| 1098492 | 2/1961 | Fed. Rep. of Germany . |
| 421412 | 3/1967 | Switzerland . |

OTHER PUBLICATIONS

Tech Data Catalog No. 16682, "FW-60-SR and SRC Champion Chemical Washer", Apr. 1979.

*Primary Examiner*—Marc L. Caroff

*Attorney, Agent, or Firm*—Shanley, O'Neil and Baker

[57] ABSTRACT

Soiled foodware is cleaned in a batch-type machine in which the foodware is subjected to a washing cycle and a chemical sanitizing rinsing cycle. A controlled flow of fresh preheated rinse water is supplied to an accumulation tank during the wash cycle while a drying agent is optionally added to the water in the tank. Thereafter, the rinse cycle is initiated by pumping the accumulated fresh water into a rinse line at a predetermined pressure to provide uniform flow in the rinse line. A liquid chemical sanitizing agent is then introduced directly into the uniform flow of water in the rinse line. This sequence of operations provides a desired uniform water pressure, independent of water supply pressure, for effective rinsing action and accurate metering of sanitizing agent into the uniform flow of water in the rinse line. Direct introduction of sanitizing agent into the rinse line minimizes contact time between the sanitizing agent and the fresh rinse water, which may contain a drying agent relatively incompatible with the sanitizing agent. Controlled flow of preheated rinse water into the accumulation tank during substantially the entire wash cycle minimizes the energy requirements of the system by reducing the heat losses in the machine.

22 Claims, 9 Drawing Figures

FIG. 2
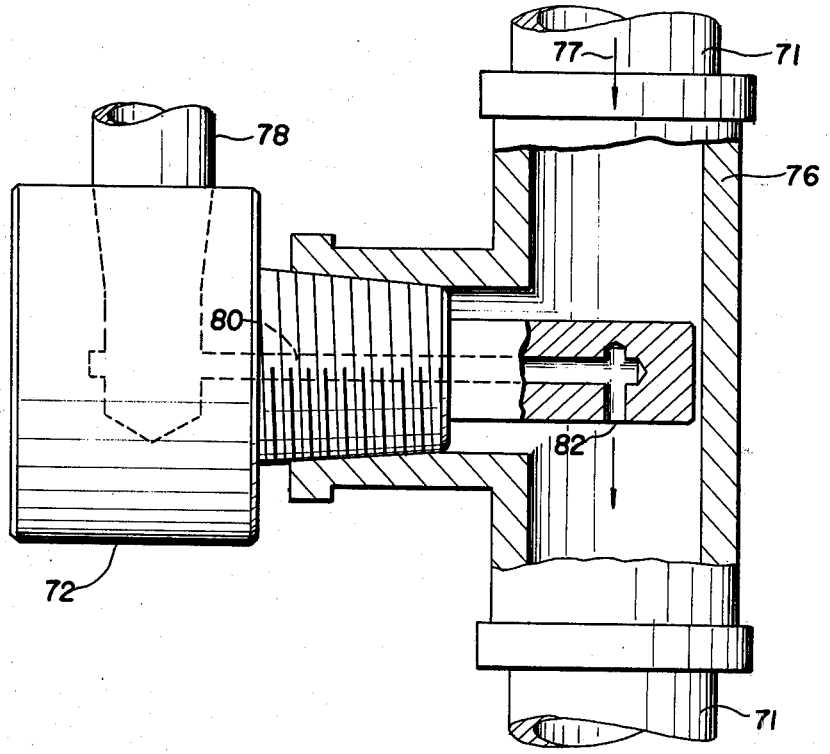
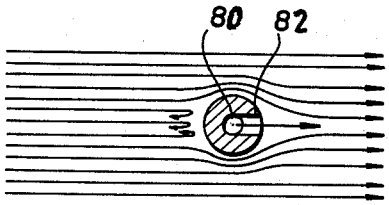
FIG. 3
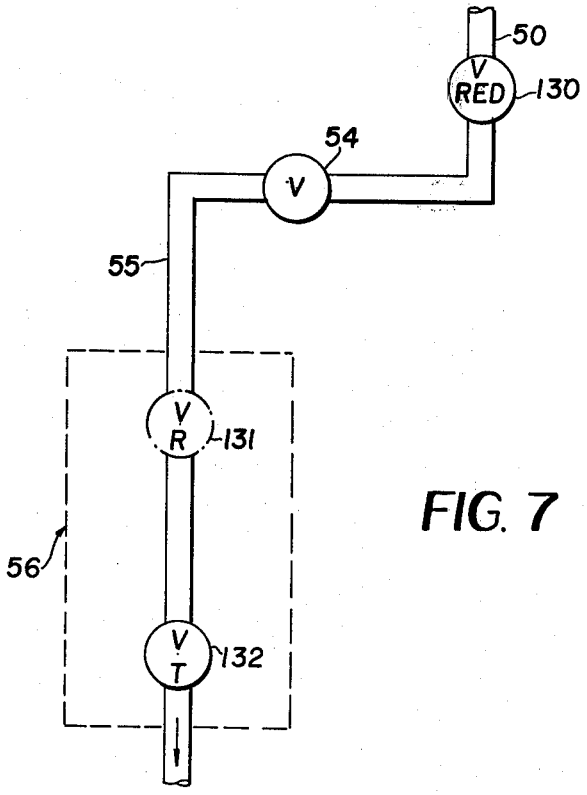
FIG. 7

LOW TEMPERATURE WASHING AND CHEMICAL SANITIZING OF FOODWARE

This invention is concerned with methods and apparatus for batch-type low-temperature cleansing of foodware items.

Low temperature (120°-140° F.) dishwashing relies on use of a chemical bactericidal agent in place of high temperature (180° F. and above) water in order to achieve the desired level of destruction of bacterial and microbial life.

Separate systems for storing, pumping, and spraying of wash water and of rinse water while utilizing rinse water recovery for a subsequent wash phase have been in use for many years in both high and low temperature dishwashing operations of the batch and continuous types. What has not been available commercially is a suitably economic and effective automatic, batch-type, cycle and apparatus providing fast cycle times to meet high production rate standards of the industry while minimizing energy demand rate at the installation site.

Part of the impediment in the past to achieving the above goals in low-temperature dishwashers has involved addition of the chemical sanitizer. The practice of aspirating a liquid sanitizer in the rinse water line encountered difficulties such as maintaining accuracy in metering due to precipitate clogging of passages.

Premixing of the liquid sanitizer in a rinse solution mixing tank in order to avoid metering accuracy problems has other disadvantages. For example, the mixing tank and pump for such premixed sanitizing solutions require special corrosion protection because of the chemical sanitizer. Also, chemical sanitizing ability can be lost before rinse spraying while the chemical sanitizing solution is accumulating, and after accumulation, in such premix tanks.

Other impediments to provision of a commercial practical, batch-type, chemical sanitizing dishwasher which maximizes production rate while minimizing the energy demand rate have involved handling of varying installation site conditions especially when less than optimum water temperature and water pressure conditions are encountered.

The low-temperature, batch-type dishwashing apparatus of the present invention provides for economical operation which is self-adaptable to varying conditions and differing installation sites, including operation at installation sites where low temperature recovery rate and/or low pressure water supply have made reliably effective automatic dishwashing difficult with commercially available low-temperature chemical-sanitizing machines.

Other advantages and contributions of the invention are considered in a more detailed description based on the accompanying drawings, in which:

FIG. 2 is a cross section view of chemical sanitizer injection apparatus forming part of the invention;

FIG. 3 represents flow conditions established by the injection apparatus of FIG. 2;

Figure 6A:
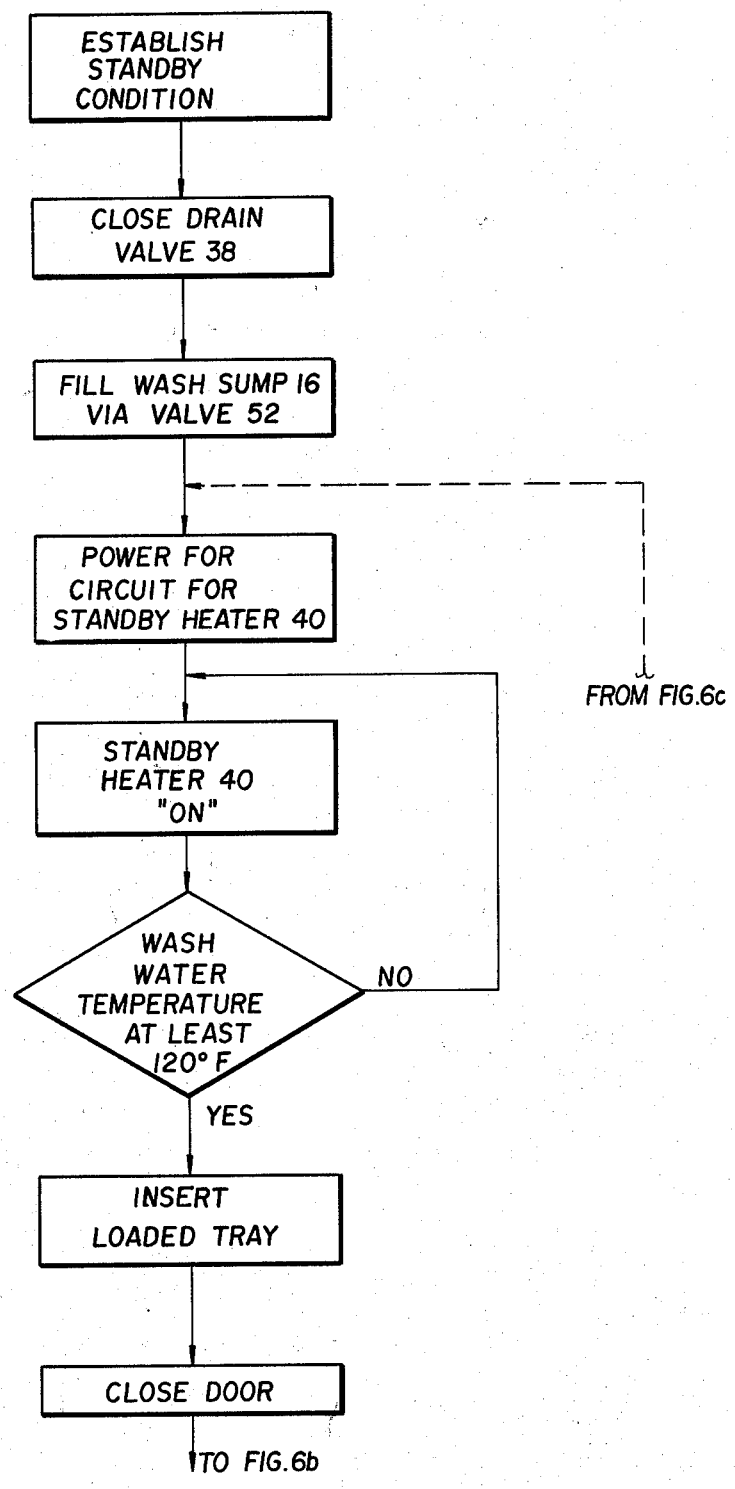
Figure 6B:
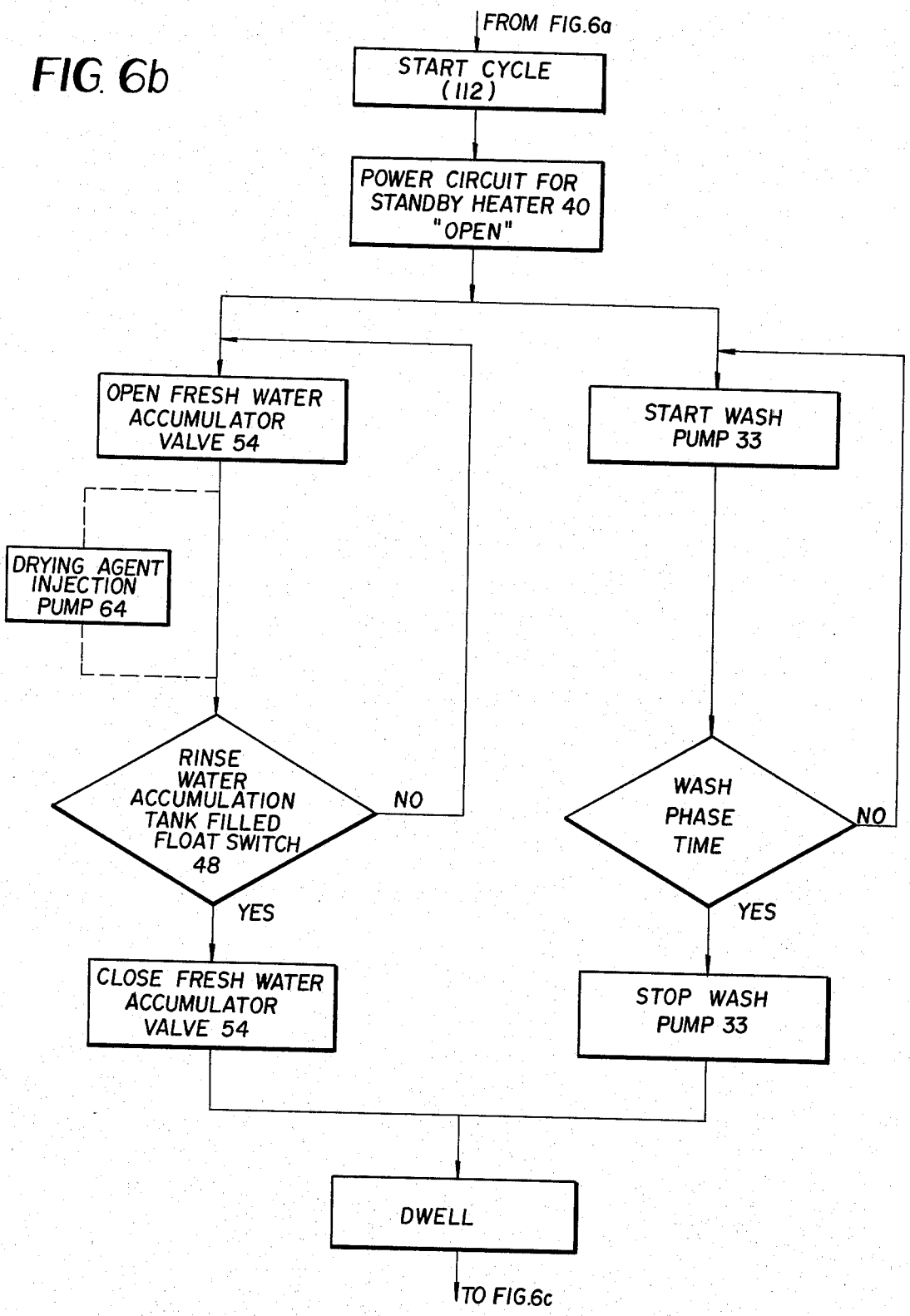
Figure 6C:
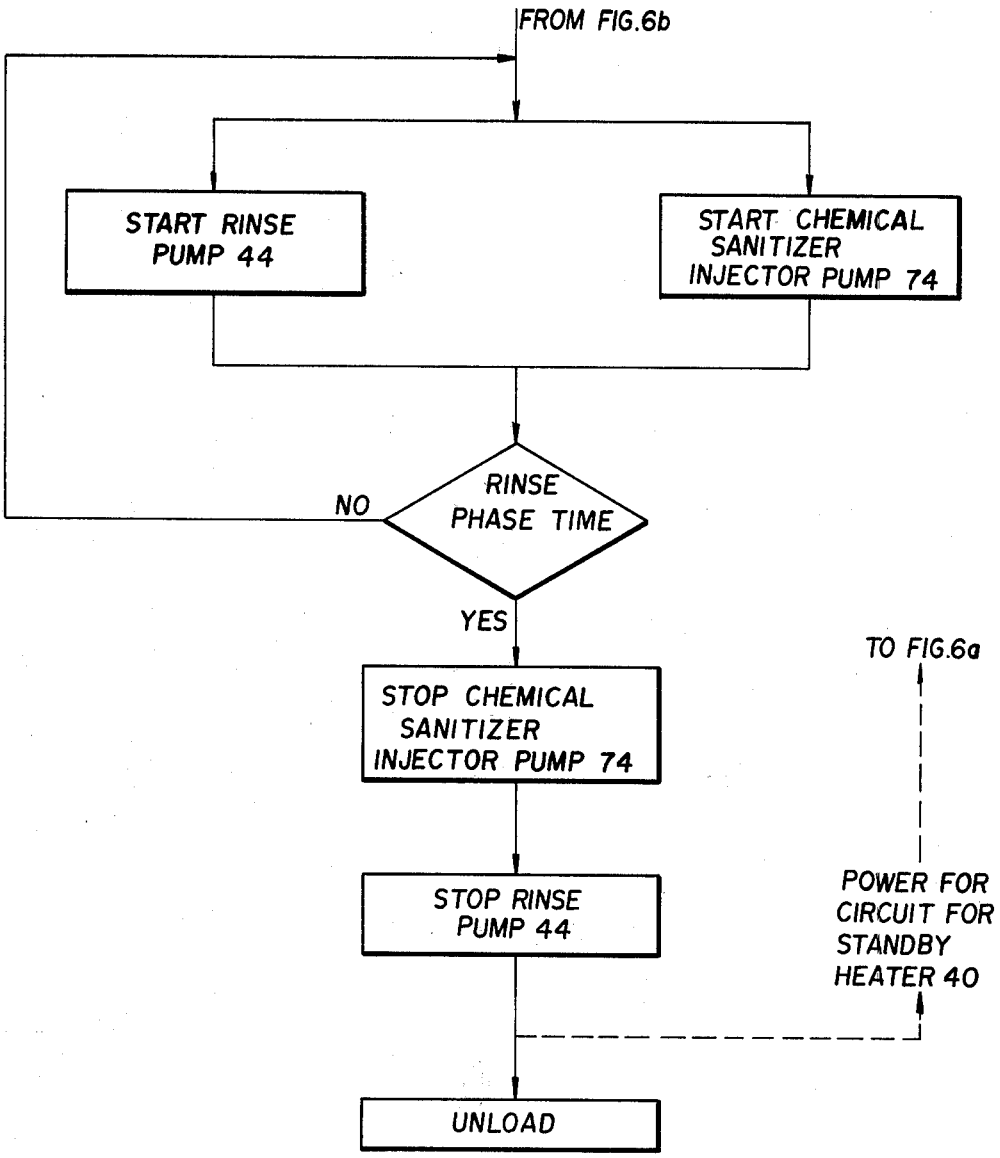

FIGS. 6(*a*), 6(*b*) and 6(*c*) present a flow chart of the cycle of the invention for electronic processor controls; and FIG. 7 is a schematic illustration of fresh water flow regulation apparatus forming part of the invention.

Figure 1:
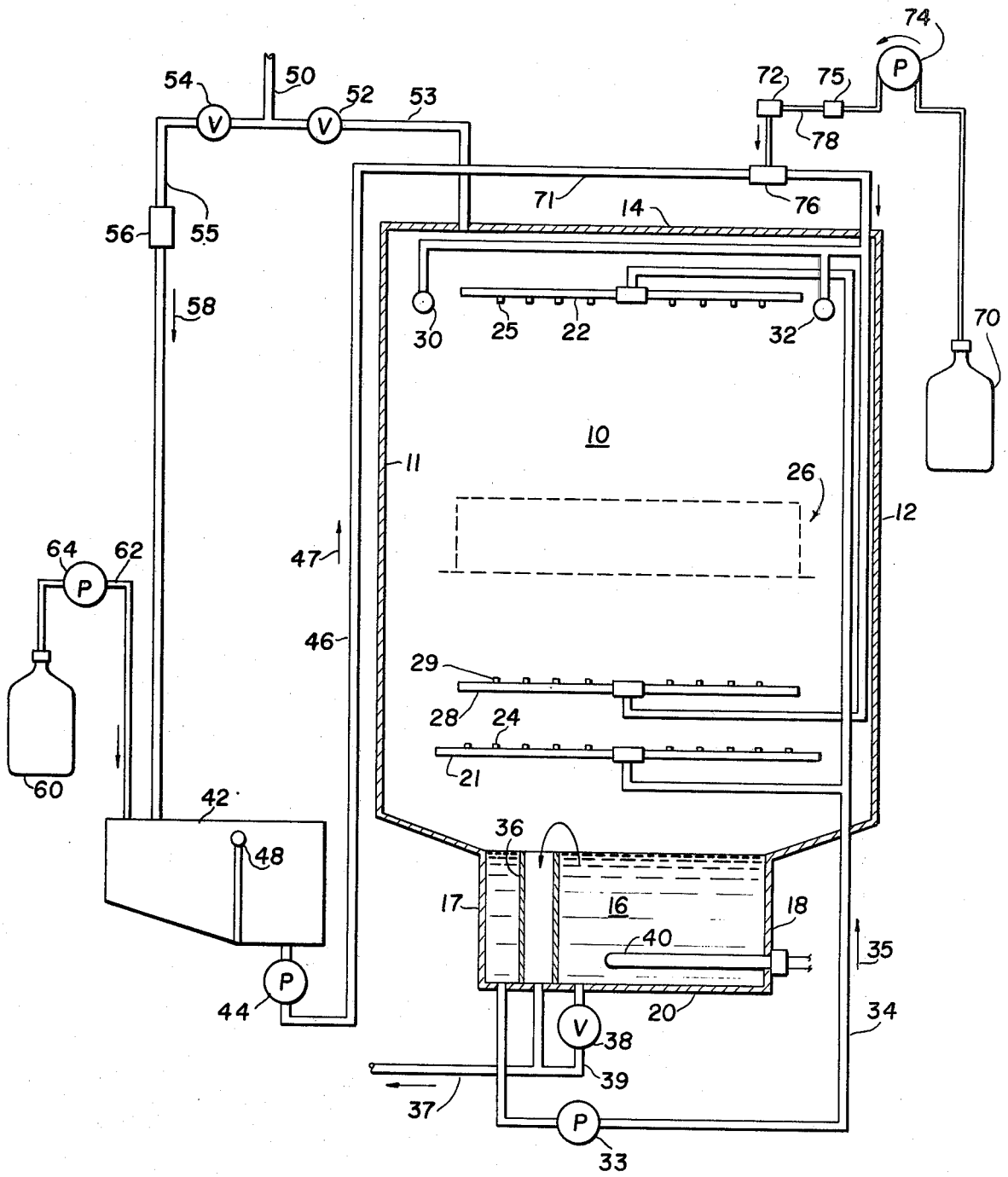
FIG. 1 is a schematic general arrangement view, partially in cross section, of a batch-type, low-temperature dishwashing apparatus embodying the invention.

In the batch-type, low-temperature wash and chemical sanitizing dishwasher of FIG. 1, a common chamber 10 is provided for washing and rinsing of foodware items. Chamber doors (not shown) provide access for loading and unloading of the chamber 10 with a tray of dishes, glasses, utensils, or similar items which are to be cleaned and treated to reduce bacterial life to a prescribed level.

Chamber 10 is defined by side walls 11 and 12, top wall 14, and an integral wash water sump 16; the latter is defined by side walls 17, 18 and bottom wall 20.

Wash spray arms 21 and 22 are mounted within chamber 10 to be rotatably driven by the force of high velocity jets of wash water exiting from nozzles such as 24 and 25. Wash spray arm 21 is located below and wash spray arm 22 is located above an open mesh rack and tray shown in broken lines at 26 in chamber 10.

Rinse spray means in chamber 10 include a lower, rotatable, rinse water spray arm 28, with nozzles such as 29, and fixed rinse nozzles, such as 30, 32, distributed about the upper portion of chamber 10.

Wash water from sump 16 is pressurized to desired pressure by wash pump 33. A predetermined concentration of detergent can be maintained in wash sump 16 automatically by commercially available means, the operation of which is well known and requires no further description to an understanding of the invention.

During a wash phase, wash water is pumped through wash water standpipe 34, as indicated by arrow 35, to wash spray arms 21 and 22. Wash solution, after spraying, drains into sump 16.

Similarly, during the rinse phase, rinse solution drains, after spraying of the load, into wash sump 16. An overflow pipe 36 leading to drain line 37 removes excess water providing flotation skimming of food particles.

Sump drain valve 38 permits complete drainage of sump 16 through drain pipe 39 for periodic cleaning or shutdown.

Means are provided for selected machine augmented heating of wash water. In the illustrated embodiment, an electrically powered heating coil 40 is submerged below water level in wash sump 16. Operation in accordance with the invention limits heat augmentation to the standby condition. Heater coil 40 is operable only when immersed in wash water and, is controlled to be operable only when thermostatically required in the absence of machine cycling.

A separate fresh water accumulation tank 42 is provided. In accordance with the invention, tank 42 has a capacity in proportion to the dishwashing apparatus and the capacity of wash sump 16. After accumulation of a prescribed volume of fresh water, rinse pump 44 drains tank 42 and pressurizes the fresh water to a desired level for flow through standpipe 46, in the direction indicated by arrow 47, toward spray means within chamber 10.

A water level sensor 48, which can be a conventional float type for providing on/off electrical signal control of fresh water supply, is mounted within fresh water accumulation tank 42.

Water is supplied through water source pipe 50. Valve 52 in line 53 can be manually or electrically operable. Filling wash sump 16, through line 53, is part of establishing the standby condition for machine cycling.

The capacity of wash sump 16 and the volume of fresh water accumulated in tank 42 are proportioned to maintain desired wash water characteristics, wash water temperature, and wash water level in sump 16 during cycling through drainage of chemically sanitizing rinse water into sump 16 after rinse spraying. Therefore, sump 16 is filled through line 53 only when initiating a standby condition. Valve 38 is closed during cycling and remains closed when the machine is in standby condition.

Electrically operable solenoid valve 54 provides on/-off controlled flow of fresh water, preheated at the installation site, through pipe 55.

An important aspect in maximizing the time for accumulation of preheated fresh water and minimizing energy demand rate at the installation site is the flow rate regulation which provides for accumulating fresh water in tank 42 during substantially all, or under a controlled major portion of the wash phase time. Flow regulator 56, shown schematically in FIG. 1, preferably provides both selection of water pressure for fresh water and throttling of fresh water flow rate. Direction of fresh water flow toward tank 42 is indicated by arrow 58.

While operation of on/off solenoid valve 54 can be time controlled for desired maximum utilization of wash phase time, provision is made for making valve 54 responsive to water level sensor 48 in fresh water accumulator tank 42 under certain circumstances when a prescribed fresh volume may accumulate in slightly less than the full wash phase time.

Utilizing all or substantially all of the wash phase time for accumulating fresh water has important advantages in minimizing the energy demand rate for water temperature recovery at the site. Use of flow rate regulation features as taught makes the cycle economically and automatically adaptable to varying conditions at an installation site or at differing installation sites.

A drying agent, which facilitates spot-free drying, can be added to fresh water accumulator tank 42 from additive reservoir 60 through tube 62 by metering pump 64. Other means can be provided for introducing such an additive into accumulator tank 42 at the proper time in the cycle.

Chemical sanitizer is not added into the fresh water accumulator tank 42. In accordance with the invention, liquid chemical sanitizing agent is introduced directly into a rinse line, e.g. by pressurized, metered injection. As shown in FIG. 1, liquid chemical sanitizer is pumped into water flowing in line 71 by injector 72 shortly prior to spraying through the rinse nozzles within chamber 10.

A positive pressure pump 74, such as a peristaltic pump of selected size proportional to the use, is time controlled to accurately meter chemical sanitizing agent from reservoir 70 into the pressurized fresh water flow during substantially the full rinse phase time. Check valve 75 protects pump 74 from the pressure imparted by pump 44 and helps increase the life of peristaltic type metering pumps.

Injector 72 is mounted in rinse line 71 so as to facilitate injection and mixing. As shown in FIG. 2, a connector "T" 76 is mounted in line 71 contiguous to its point of entry into chamber 10. Water flow in line 71 is indicated by arrow 77. Injector 72, connected to liquid chemical sanitizing agent tube 78, directs chemical sanitizing agent along conduit 80 to outlet 82; the latter opens within the flow stream so as to provide injection having a directional component in the direction of water flow.

As shown in the flow pattern of FIG. 3, outlet 82 empties into the water stream at a point of low pressure relative to the pressure established by pump 44; this facilitates injection and helps minimize pressure requirements of pump 74. The injector discharge point is located within the center line of the injector "T" to insure optimum mixing of sanitizer with the water.

In addition to the features of positive pressure, direct and uniform injection, and accurate metering available with the described apparatus, by introducing the sanitizer directly into the water flow shortly prior to rinse spraying, evaporative loss of sanitizing capabilities in fresh water holding tank 42 is avoided. Also, when a drying agent from reservoir 60 is added to tank 42, the widely separate points of addition of sanitizer and drying agent, and the short interval of contact of such drying agent rinse additive and injected chemical sanitizing agent before spraying, helps to relieve concern about compatability of rinse additives and chemical sanitizing agents, or concern with a disassociation which could reduce sanitizing effectiveness when both agents are utilized and premixed for some time at 140° F. prior to spraying.

Figure 4:
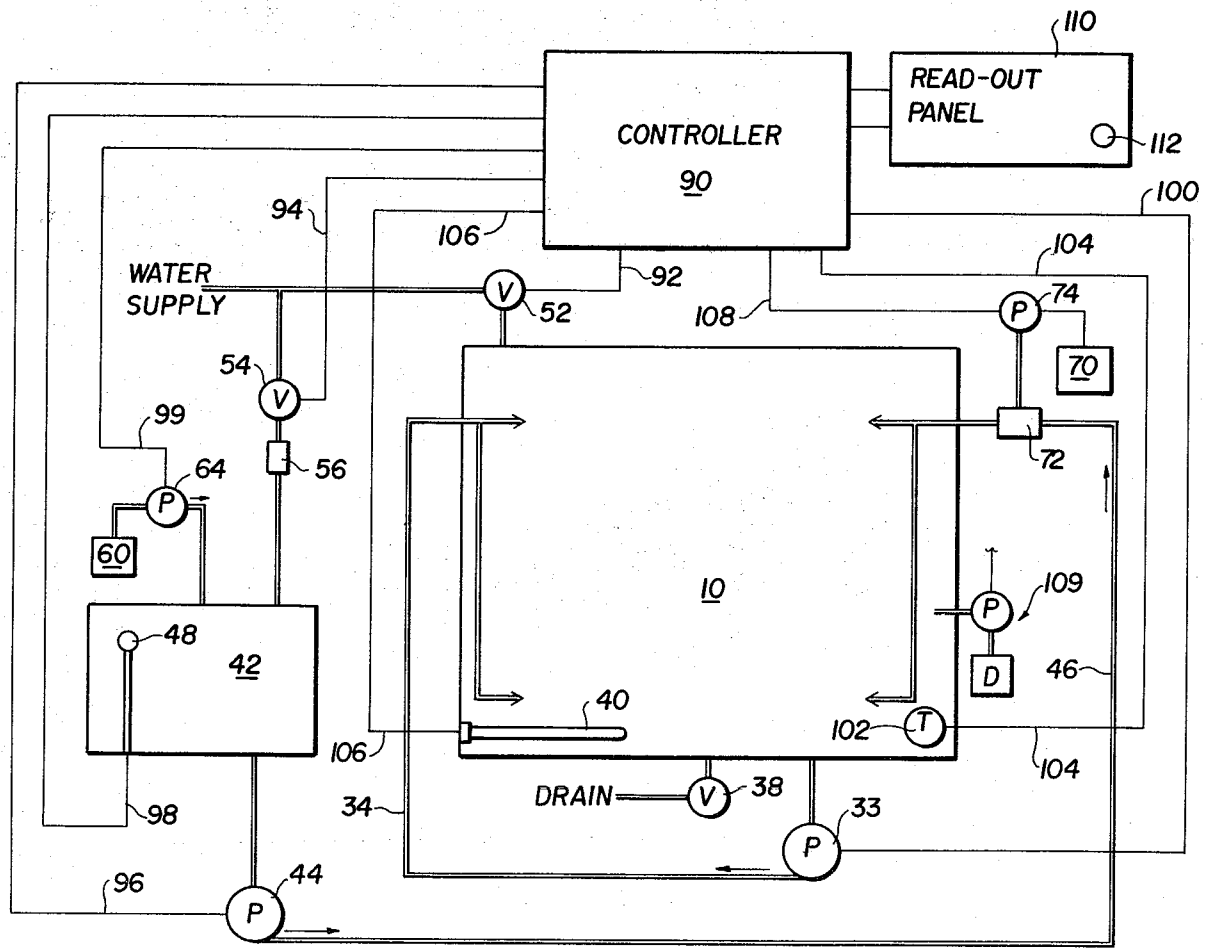
FIG. 4 is a schematic of apparatus embodying the invention for automatic batch-type washing and chemical sanitizing of foodware items.

In the automatic dishwasher schematic of FIG. 4, controller 90 provides automatic timed control of electrically operable solenoid valves and pumps such as those shown in FIG. 1 (the same reference numbers are used in the drawings for elements having the same function). Wash sump fill valve 52 can be manually operated, or connected to controller 90 through control line 92 and controlled to remain closed after filling sump 16 to place the unit in standby condition.

Electrical control for fresh water supply valve 54 is connected to controller 90 through control line 94 and electrical actuating control for pump 44 is connected through control line 96. The electrical signal from float switch 48 is connected through line 98; drying agent pump 64 is connected through control line 99 and wash pump 33 is connected through line 100. The electrical signal for sump wash water temperature, measured at temperature bulb 102, is connected through line 104 and on/off control signal for standby heater 40, which is responsive to temperature sensing bulb 102 during standby conditions, is connected through line 106. Electrical actuation of chemical sanitizer pump 74 is connected through line 108. Detergent can be automatically injected for each wash cycle by detergent injector means 109 which can be actuated by controller 90 or otherwise automatically operable.

Readout panel 110 can be utilized to indicate the phase in operation during a cycle, the time, the temperature of the water in wash sump 16, or other values; also, cycle start button 112 can be mounted on readout panel 110.

Through proper control of the combination of elements shown, a cycle is provided which compensates for and is self-adaptive to various conditions within selected practical ranges likely to be encountered at a particular installation site or at installations in differing regions, domestic or foreign.

Parameters can be established to make the basic cycle more adaptive to differing conditions. For example, dependent on characteristics of the food residue on the foodware items, the preselected wash phase time can be established between about forty (40) and about seventy

(70) seconds. Rinse phase times, dependent on conditions, can be established between about five (5) and about fifteen (15) seconds. A dwell time of between one (1) and five (5) is generally provided before rinsing when utilizing detergent in the wash water. About forty (40) to sixty (60) machine operations per hour are thus readily available using the basic cycle enabling achievement of industry production-rate standards with a low-energy demand rate while meeting governmental regulatory standards on cleansing and levels of bacteria kill.

The wash sump 16 is filled through line 53 only for establishing standby conditions. By preselected proportioning of the fresh water accumulation to be between about one-third and about one-half of wash sump capacity, wash water volume and desired wash water characteristics are maintained by machine cycling. A standardized low demand rate for temperature recovery for the hot water supply is provided by utilizing substantially the entire or a controlled major portion of the wash phase time for accumulation of the fresh water which is supplied preheated to about 140° F. at the installation.

Use of high-pressure, low-volume wash and rinse pumping equipment, along with relatively low wash sump capacity and fresh water accumulation volume (as set forth below), facilitate achievement of a very low demand rate of 2.4 gallons per minute, or less, water at 140° F. for a single rack dishwashing machine; such demand rate is well within the primary water heater capacity of substantially any standardly equipped restaurant or other commercial dishwashing establishment and eliminates any need for booster heating capacity at the installation site, or in the machine during cycling. For a single rack, batch-type machine, a wash sump capacity of about five (5) gallons is provided with fresh water accumulation, during the wash phase, being between about one and three quarters (1.75) and about two and one-half (2.5) gallons. This provides a turnover ratio in sump water of 1:3 or 1:2, i.e. wash water is replaced with chemically sanitized rinse water every two to three cycles.

Economies which result from such low volumetric requirements of the above proportions include low heat losses, low detergent addition requirements, low horsepower requirements, and low kilowatt hour rating for the standby heater.

Fresh water supply to the accumulation tank is regulated to utilize substantially the full wash phase time. By direct injection of a standardly used liquid chemical sanitizer (e.g. chlorine supplied as NaOCl) into the rinse line 71 shortly prior to rinse spraying, minimal chlorine injections maintain desired concentration without concern for depletion losses during extended rinse solution accumulation times. Accepted standards of concentration of chlorine, depending on the locale, are between fifty and one hundred ppm NaOCl("Ecco-San" supplied by Economics Laboratories, Inc., St. Paul, Minn.) at a rinse temperature of about 120° F. Other bactericidal agents, such as iodine, and required concentrations, are also well known in the art.

Sump wash water temperature is readily sustained at or about 120° F. by supplying fresh water at about 140° F. utilizing the above described volumetric and time values.

The industry standard for a single 20"×20" rack is twenty-five (25) dishes. The cycle can be adapted readily to a double rack machine; double rack machines require wash and spray provisions above and below each rack as in the single rack embodiment. By doubling the wash sump capacity, the volume of fresh water accumulated, and the chemical sanitizer injection, identical cycle times can be maintained for the double rack embodiment while the demand rate for 140° F. water is maintained below five (5) gallons per minute; a rate which is within primary water heater capacity of standardly equipped restaurants and other commercial dishwashing establishments without relying on booster heaters.

Figure 5:
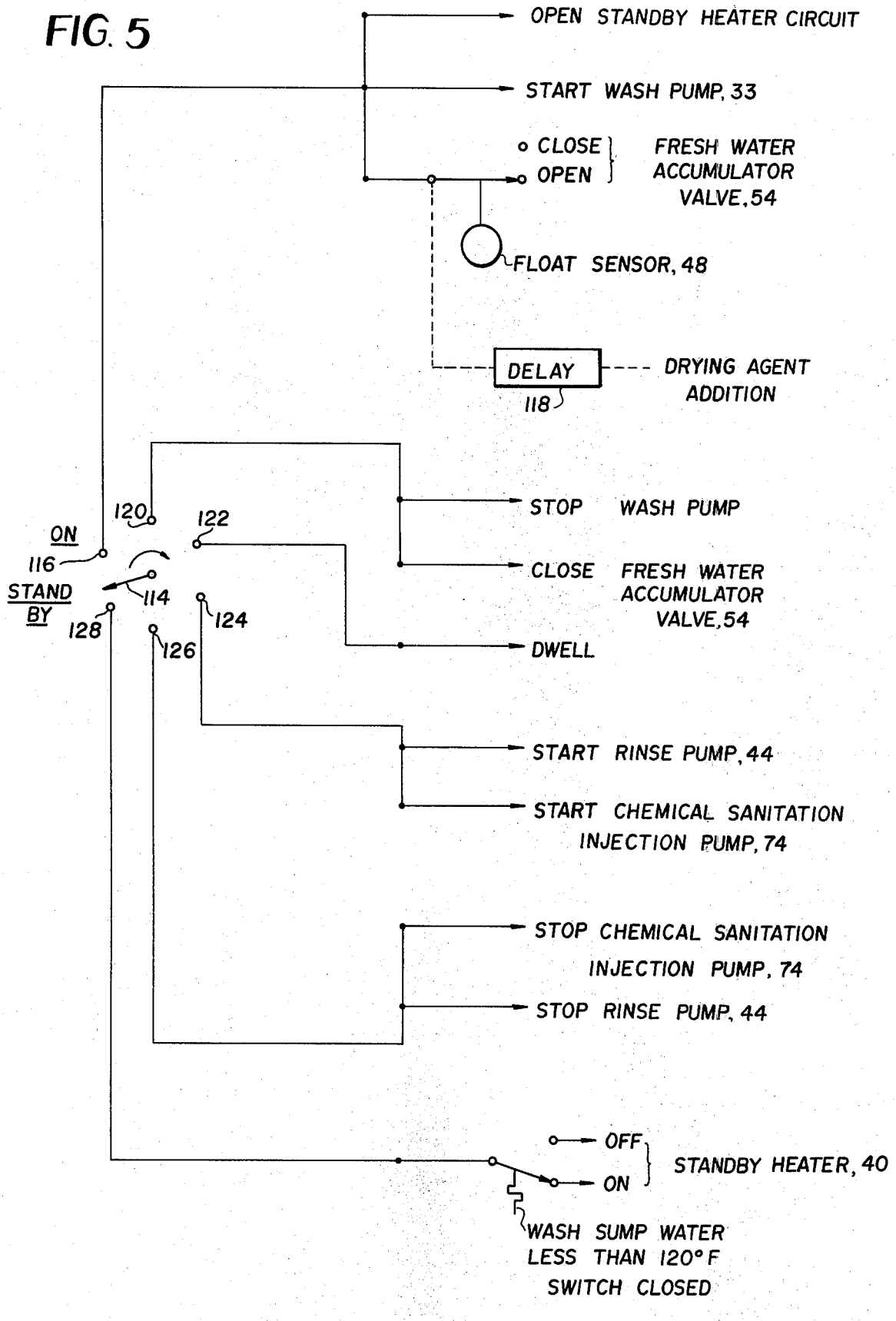
FIG. 5 is a circuit schematic of electromechanical control apparatus forming part of the invention.

Commercially available and well known electromechanical means, such as a cam-operated timer or a rotary-type solenoid, or electronic processor means, can be used for automatic timed operation of the electrically operable valves and pumps through controller 90. The circuit schematic of FIG. 5 presents representative electrochemical apparatus of the rotary solenoid type for providing the timed operation function of controller 90 for carrying out the cycle.

The flow chart starting in FIG. 6(*a*) and continuing in FIG. 6(*b*) and FIG. 6(*c*) is representative for electronic processor control equipment and can also be used for establishing electromechanical controls by those skilled in the art using commercially standardized components.

Cycling of the unit maintains sump wash water and temperature utilizing the selected fresh water volume accumulation for each cycle. With the unit in standby condition, the cycle runs automatically upon pressing of start button 112; cycling maintains wash sump water without otherwise adding to the wash water. When the machine is not cycled frequently enough to maintain sump wash water temperature, standby heater 40 is thermostatically controlled to add heat as may be required between cycles.

While establishment of all standby conditions can be automated, manual closing of the drain valve 38 and filling of the sump 16 through operation of valve 52 provides economies in reducing electrical control elements and is considered efficient because of the infrequency of the requirement. As indicated by the flow chart of FIG. 6(*a*), drain valve 38 is closed and, wash sump 16 is filled by operation of valve 52. When the sump 16 is filled, wash water is automatically maintained at desired temperature by thermostatic control of heater 40.

After insertion of a tray loaded with soiled dishes and closing of the access door, the cycle is started by pressing start button 112. In the rotary solenoid embodiment of FIG. 5, rotary switch arm 114 is moved to start position 116. At such position, an on/off switch opens in the electrical power circuit for standby heater 40, wash pump 33 is actuated, and fresh water accumulator valve 54 opens.

As discussed, fresh water is accumulated substantially throughout the entire or a controlled major portion of the wash phase time. In the latter circumstance, or if through a breakdown in flow regulator equipment the preselected volume of fresh water accumulates before expiration of the wash phase time, a signal from float level sensor 48 overrides, as represented in FIG. 5, the wash phase timed signal and closes valve 54.

If drying agent is to be utilized (indicated by a broken line in FIG. 5), it is added to the fresh water accumulation tank 42 during the wash phase time. Typically, a single addition of drying agent is made at about ten (10) to twenty (20) seconds after start of fresh water accumulation, such timing being represented by delay element 118. For the single rack embodiment described, a single addition of about two (2) cc of a standardly used drying agent such as "Jet Dry," supplied by Economics Laboratories, Inc., St. Paul, Minn., is utilized.

As the wash phase time expires, rotary solenoid arm 114 switches to position 120 which stops the wash pump 33 and closes valve 54, if the latter has not been closed by actuation of float sensor 48.

Rotary solenoid arm 114 is then automatically shifted to position 122 for a preselected dwell time. A dwell between detergent washing and rinsing is provided to allow for proper drip drainage of wash water with the detergent into the sump so as to help reduce detergent spotting of foodware items upon drying.

After the dwell time, rotary solenoid arm 114 switches to position 124 to start the rinse phase. Rinse pump 44 for fresh water accumulated in tank 42 is energized to start flow, at desired pressure, through standpipe 46 and line 71 toward the rinse nozzles. Chemical sanitizer pump 74 is actuated to inject chemical sanitizer as previously described.

At the conclusion of the rinse phase time, rotary solenoid arm 114 switches to position 126, which stops pump 44 and sanitizer pump 74. Arm 114 then switches to position 128 which places the unit in the standby condition for unloading and reloading; thermostatic controlled maintenance of sump wash water temperature is provided as indicated.

The steps enumerated in relation to FIG. 5 can readily be followed on the flow chart of FIGS. 6(*a*), 6(*b*) and 6(*c*) as presented without further detailed description.

The wash phase and rinse phase times are established for a unit dependent on the type of service required. Typical automatic programmed cycle values for "Average Conditions" which might be encountered in a typical domestic restaurant and, for "Difficult Cleaning Conditions" which might be encountered in attempting to remove food residues having a high percentage of oil, especially fish oils, are set forth in Table I below:

TABLE I

| | Average Conditions | Difficult Cleaning Conditions |
|---|---|---|
| Wash Sump Capacity | 4.5 gallons | 4.5 gallons |
| Fresh Water Accumulation | 1.8 gallons | 2.2 gallons |
| Fresh Water Supply, Temperature | about 140° F. | about 140° F. |
| Wash Phase Time | 45 seconds | 67.5 seconds |
| Dwell Time | 1 second | 1.5 seconds |
| Rinse Phase Time | 9 seconds | 13.5 seconds |
| Total Cycle Time (exclusive of loading and unloading) | 55 seconds | 82.5 seconds |
| Demand Rate at 140° F. | 2.4 gpm | 2.4 gpm |
| Rating for Heater Coil 40 | 1.5 KWH | 3.0 KWH |

The regulation of fresh water accumulation rate, as taught, can be carried out in a number of ways using pressure regulation and throttling. A water pressure range having a lower limit (e.g. 10 psi), below that generally considered acceptable, can be selected without detriment to cycle times. A pressure reducing valve can be placed in the main water line 50 to the machine or in line 55 to the fresh water accumulation tank 42.

FIG. 7 shows representative elements for desired regulation to accomplish the objects of the invention. A pressure reducing valve, either in line 50 at 130, or as part of regulator 56 shown in broken lines at 131, reduces water line pressure to a selected value or a selected range, e.g. between 10 and 20 psi.

An orifice valve 132 is selected to regulate flow of fresh water to the accumulation tank to a rate which utilizes the full wash phase time at the selected low pressure or the low pressure value of the water pressure range selected by the pressure reducing valve.

Providing a low energy demand rate and adaptability to varying conditions are facilitated by such flow control of fresh water. Establishing a fresh water supply range extending to as low as ten (10) psi provides for low pressure installation sites without any loss in productivity while high water pressure surges which could place excessive demands on installation heater capacity, resulting in low water temperature supply, are eliminated.

Reduction to a single practical low pressure likely to be encountered extends fresh water accumulation time over substantially the full wash phase time in each cycle; the described float sensor override would then be utilized as a safety measure to prevent overflow of tank 42 under unusual circumstances. The extended wash phase times made available for addition of about two gallons of fresh preheated water automatically provide a low demand rate which can be specified in advance to the user.

This flow control of fresh water can be carried out with known hardware and, can be accomplished by means other than as specified in relation to FIG. 7. Where water supply line pressure is regulated at the installation site, a pressure reducing valve within the unit itself as a part of flow control means 56 can be eliminated.

A pressure reducing valve in line 50 reduces pressure in sump fill line 53. While this approach would generally be considered too detrimental for operation of most dishwashing units, with the present teachings, where wash water is provided through fill line 53 only when initially establishing standby conditions, any time delay caused in filling wash sump 16 is not significant and has no effect on cycle times.

Diaphragm-type, combined pressure-reducing and throttling valves, available in the marketplace, could also be used to provide the desired flow rate control.

For the high-pressure, low volume operation described, closed centrifugal pumps are preferred for wash pump 33 and rinse pump 44. Typical wash water pressure is 15 to 20 psi and typical rinse water pressure is 18 to 22 psi. Such pumps are available in the market as are the other pumps and valves described.

Selection of such individual elements, or substitution of equivalent elements and other modifications, can readily be made by one skilled in the art in the light of the above teachings on their combination and control. Therefore, in evaluating the scope of the present invention, reference should be made to the appended claims.

We claim:

1. Method for operating a batch-type machine providing washing of soiled foodwares and chemical sanitizing rinsing of washed foodwares to maximize productivity while minimizing energy demand rate at an installation site, comprising providing a foodware cleansing machine having a single wash and rinse chamber with a wash water sump which, after an initial filling with wash water, is maintained at a desired wash water level and a desired wash water temperature by drainage of water into such wash water sump after wash and rinse spraying of foodware items, such foodware cleansing machine including a separate fresh water accumulation tank capable of holding a volume of fresh water preselected to be at least one-third to about one-half the capacity of the wash sump at such desired wash water level, inserting a load of foodware items into such foodware cleansing machine chamber, establishing a preselected wash phase time, establishing a preselected rinse phase time, such rinse phase time being preselected to be between about one-tenth and about one-half the wash phase time, washing the load of soiled foodware items by pumping wash water from the wash sump to provide pressurized discharge of such wash water for wash spraying of such foodware item load, controlling pumping of such wash water such that such pressurized wash spraying extends over such preselected wash phase time, controlling supply of preheated fresh water to such fresh water accumulation tank including control of flow rate of such fresh water, such control causing flow of fresh water from the installation site into such accumulation tank to start substantially simultaneously with initiation of pumping of washing water from the wash sump and to extend over substantially the entire preselected wash phase time, terminating pumping of wash water from such wash sump at expiration of such predetermined wash phase time, then pumping such accumulated fresh water at a predetermined pressure to provide uniform flow of such accumulated fresh water within a rinse line to provide pressurized discharge for rinse spraying on such washed load, controlling pumping of the accumulated fresh water such that pressurized rinse spraying extends over such preselected rinse phase time, introducing a liquid chemical sanitizing agent into such flow of fresh water in the rinse line, such introduction of liquid chemical sanitizing agent into such rinse line taking place shortly prior to such rinse spraying on such washed load, controlling introduction of liquid chemical sanitizing agent to take place over at least a predetermined major portion of the preselected rinse phase time, terminating introduction of liquid chemical sanitizing agent, and, with expiration of such preselected rinse phase time, terminating pressurized pumping of fresh water in the rinse line to complete a cycle prior to unloading of such washed and rinsed foodware item load.

2. The method of claim 1 further including during such wash phase time the steps of sensing the volume of fresh water in the fresh water accumulation tank at least when such accumulating fresh water reaches the predetermined volume between one-third and about one-half of wash sump capacity, and terminating flow of fresh water into such accumulation tank responsive to sensing of accumulated fresh water when such predetermined volume of fresh water is accumulated in such accumulation tank prior to expiration of the preselected wash phase time.

3. The method of claim 1 or 2 including the step of pressurizing such liquid chemical sanitizing agent for introduction into such rinse line, such step of introducing liquid chemical sanitizing agent comprising pressurized injection of liquid chemical sanitizing agent to have a component of movement, as injected into the rinse line, in the direction of fresh water flow.

4. The method of claim 1 or 2 including providing electrically operable heating means for wash water held in the wash sump, and thermostatically controlling actuation of such sump wash water heating means, such thermostatically controlled actuation of such heating means being limited to occur only when such machine is in a standby condition for cycling to wash and rinse a machine load.

5. The method of claim 1 in which such step of controlling fresh water supply to the fresh water accumulation tank includes controlling pressure of fresh water supply to the fresh water accumulation tank, and throttling flow rate of such pressure controlled fresh water supply.

6. The method of claim 2 in which such step of controlling supply of fresh water for accumulation in the fresh water accumulation tank includes the steps of controlling pressure of such supply of fresh water to be within a preselected range of pressures, and throttling flow rate of such fresh water to accumulate such preselected volume of fresh water in a time period corresponding to the predetermined wash phase time when such fresh water is supplied at the minimum pressure within such preselected range of controlled pressure for the fresh water supply.

7. The method of claim 1 or 2 in which the foodware cleansing machine comprises a single-rack washing and rinsing apparatus having a wash sump with a minimum capacity of about four and one-half gallons, and in which such preselected wash phase time is established in the range of about forty seconds to about seventy seconds, and such preselected rinse phase time is established in the range of about five to about fifteen seconds.

8. The method of claim 1 or 2 further including the step of providing a predetermined dwell time after termination of pumping of wash water and before starting pumping of accumulated fresh water.

9. The method of claim 1 or 2 further including adding a drying agent to the fresh water accumulation tank during flow of fresh water into such tank.

10. Method for operating a batch-type machine providing washing of soiled foodwares and chemical sanitizing rinsing of washed foodwares to maximize production rate while minimizing energy demand rate at an installation site, comprising providing a foodware cleansing machine having a single wash and rinse chamber with a wash water sump which, after an initial filling with wash water, is maintained at a desired wash water level and a desired wash water temperature by drainage of water into such wash water sump after wash and rinse spraying of foodware items, such foodware cleansing machine including a separate fresh water accumulation tank capable of holding a predetermined volume of fresh water between at least about one-third and about one-half the capacity of the wash sump and preheated above desired wash water temperature, inserting a load of foodware items into the foodware cleansing machine, establishing a preselected wash phase time, establishing a preselected rinse phase time, washing the load of soiled foodware items by pumping wash water from the wash sump to provide pressurized discharge of such wash water on such foodware items, controlling pumping of such wash water such that such pressurized wash spraying extends over such preselected wash phase time, terminating pumping of wash water from such wash sump at expiration of such predetermined wash phase time, providing a dwell time after terminating such wash spraying for drip drainage of wash water into the wash sump, controlling supply of preheated fresh water from the installation site to such fresh water accumulation tank including control of flow rate of such fresh water, such control causing flow of fresh water into such accumulation tank to start substantially simultaneously with initiation of pumping of wash water from the wash sump and to extend predeterminedly during such wash phase time, sensing the volume of fresh water accumulated in the fresh water accumulation tank at least when such accumulating fresh water reaches the preselected volume between one-third and about one-half of wash sump capacity, such control of fresh water flow rate causing flow of fresh water into such accumulation tank means to extend over substantially the entire preselected wash phase time while providing for terminating flow of fresh water into such accumulation tank when such preselected volume of fresh water in the fresh water accumulation tank is sensed prior to expiration of the preselected wash phase time, terminating flow of fresh water to such accumulation tank at expiration of such predetermined wash phase time unless earlier terminated responsive to sensing accumulation of such preselected volume of fresh water, pumping such accumulated fresh water at a predetermined pressure to provide uniform flow of such accumulated fresh water within a rinse line to provide pressurized discharge for rinse spraying onto such washed load, controlling pumping of such accumulated fresh water to extend over such preselected rinse phase time, pressurizing a liquid chemical sanitizing agent, injecting such liquid chemical sanitizing agent under pressure into such flow of fresh water in the rinse line, such injecting of liquid chemical sanitizing agent into such rinse line taking place shortly prior to the pressurized rinse spraying on such washed load, such liquid chemical sanitizing agent being injected into such rinse line to have a component of movement in the direction of fresh water flow, controlling such pressurized injection of liquid chemical sanitizing agent to take place uniformly over at least a preselected major portion of the preselected rinse phase time, such rinse phase time being preselected to be between about one-tenth and about one-half the wash phase time, terminating pressurized injection of liquid chemical sanitizing agent, and with expiration of such preselected rinse phase time, terminating pressurized pumping of fresh water in the rinse to complete a cycle prior to unloading of such washed and rinsed foodware item load.

11. Batch-type foodware cleansing apparatus for washing of soiled foodware items followed by chemical sanitizing rinsing of washed foodware items comprising enclosure means for receiving a load of foodware items including a single chamber for washing and rinsing of such items, wash sump means of predetermined capacity for holding wash water and receiving wash water and rinse water after spraying over foodware items in the chamber, wash spray means in the chamber, wash pump means for pressurized pumping of water from the wash sump means to wash spray means in the chamber, a separate fresh water accumulation tank means capable of holding a volume of preheated fresh water between about one-third and about one-half the capacity of the wash sump, fresh water supply line means connected to the fresh water accumulation tank means, flow control means in such fresh water supply line means for controlling fresh water flow into such fresh water accumulation tank means, such flow control means including flow rate control means, rinse spray means located in the chamber means, a rinse line extending from the fresh water accumulation tank means to the rinse spray means, rinse pump means for pressurized pumping of water from the fresh water accumulation tank means to the rinse spray means, means for supplying liquid chemical sanitizing agent, means for introducing liquid chemical sanitizing agent into the rinse line at a location contiguous to entry into the chamber, and means controlling cycling of such foodware cleansing apparatus including controlling actuation of such pump means for respective wash phase and rinse phase times such that the rinse phase time follows completion of the wash phase time and the fresh water flow to the fresh water accumulation tank means extends over at least a major portion of the wash phase time.

12. The apparatus of claim 11 in which the fresh water flow control means includes throttle valve means.

13. The apparatus of claim 11 in which the fresh water flow control means includes pressure regulating means for the fresh water supply to such accumulation tank means, and throttle valve means to extend fresh water accumulation over substantially the entire wash phase time.

14. The apparatus of claim 11 in which the fresh water flow control means includes pressure reducing means operable in a selected range, and throttle valve means operable to extend fresh water flow over substantially the entire wash phase time at the minimum selected pressure of such pressure reducing range.

15. The apparatus of claim 11 further including means for pressurizing the liquid chemical sanitizing agent, and in which the means for introducing liquid chemical sanitizing agent includes injector means for injecting liquid chemical sanitizing agent under pressure into the rinse line.

16. The apparatus of claim 15 in which the means for injecting liquid chemical sanitizing agent includes means for discharging pressurized liquid chemical sanitizing agent into the rinse line with a component of discharge in the direction of flow of fresh water in the rinse line.

17. The apparatus of claim 11 further including means for adding a drying agent into the fresh water accumulation tank means, with such control means providing for such addition of drying agent taking place after initiation of fresh water flow while fresh water is accumulating in such accumulation tank means.

18. The apparatus of claim 11 including means for filling the wash sump means prior to initiation of such controlled cycling, such means including on/off value means.

19. The apparatus of claim 18 further including electrically operable heating means for wash water in the wash water sump, and thermostatic control means for such heating means, in which the means for controlling cycling of the foodware cleansing apparatus limits actuation of such heating means under control of the thermostatic control means to a standby condition at times other than controlled cycling of the apparatus when the wash sump is filled.

20. The apparatus of claim 11 or 19 in which the wash sump means includes overflow means for establishing the predetermined capacity of the wash sump means and providing for flotation skimming of food particles from such sump wash water.

21. The apparatus of claim 20 in which such wash sump means has a minimum capacity of about four and one-half gallons, such fresh water accumulation tank has a capacity to permit accumulation of at least about 1.75 to about 2.5 gallons.

22. The apparatus of claim 11 further including electrically operable on/off valve means in the fresh water supply line means, means for sensing fresh water volume accumulation in such accumulation tank means at least when such accumulated volume equals a preselected value and, in which the means for controlling cycling of the apparatus terminates flow of fresh water to such accumulation tank means responsively to such sensing means for determining fresh water volume accumulation.

* * * * *